US007737396B2

(12) United States Patent
Chernushevich et al.

(10) Patent No.: US 7,737,396 B2
(45) Date of Patent: Jun. 15, 2010

(54) ION FRAGMENTATION IN MASS SPECTROMETRY

(75) Inventors: Igor Chernushevich, North York (CA); Alexandre V. Loboda, Toronto (CA)

(73) Assignee: MDS Analytical Technologies, a business unit of MDS Inc.

( * ) Notice: Subject to any disclaimer, the term of this patent is extended or adjusted under 35 U.S.C. 154(b) by 0 days.

(21) Appl. No.: 12/362,831

(22) Filed: Jan. 30, 2009

(65) Prior Publication Data

US 2009/0189071 A1 Jul. 30, 2009

Related U.S. Application Data

(60) Provisional application No. 61/024,650, filed on Jan. 30, 2008.

(51) Int. Cl.
*H01J 49/40* (2006.01)
*H01J 49/42* (2006.01)

(52) U.S. Cl. ..... 250/287; 250/281; 250/282; 250/288; 250/292; 250/423 R

(58) Field of Classification Search ..... 250/287, 250/281, 282, 288, 292, 423 R, 424
See application file for complete search history.

(56) References Cited

U.S. PATENT DOCUMENTS

| | | | | |
|---|---|---|---|---|
| 6,507,019 | B2 * | 1/2003 | Chernushevich et al. | 250/287 |
| 6,512,226 | B1 | 1/2003 | Loboda et al. | |
| 6,992,285 | B1 | 1/2006 | Cousins et al. | |
| 7,227,137 | B2 | 6/2007 | Londry et al. | |
| 7,459,693 | B2 * | 12/2008 | Park et al. | 250/423 R |
| 7,547,878 | B2 * | 6/2009 | Schultz et al. | 250/282 |
| 7,557,344 | B2 * | 7/2009 | Chernushevich et al. | 250/292 |

* cited by examiner

*Primary Examiner*—Nikita Wells
(74) *Attorney, Agent, or Firm*—Bereskin & Parr LLP/S.E.N.C.R.L., s.r.l.

(57) ABSTRACT

In a tandem mass spectrometer using a collision cell for ion fragmentation, the upper limit of the collision energy required for collision induced dissociation (CID) can be extended without reaching or going beyond the upper electrical discharge limit of the system components. The present teachings describe a method of lifting the potential energy of ions to a predetermined level sufficient for CID fragmentation while satisfying a discharge free condition. The present teaching also describes a method of lifting the potential energy of the fragment ions after CID fragmentation so that the product ions have sufficient energy for mass analysis.

9 Claims, 5 Drawing Sheets

ION FRAGMENTATION IN MASS SPECTROMETRY

CROSS REFERENCE TO RELATED APPLICATIONS

This application claims the benefit of U.S. Provisional Application No. 61/024,650 filed Jan. 30, 2008, the entire contents of which are hereby incorporated by reference.

INTRODUCTION

The present teachings relate to methods and apparatus for improved ion fragmentation in tandem mass spectrometry.

Tandem mass spectrometry techniques typically involve the detection of ions that have undergone physical change(s) in a mass spectrometer. Frequently, the physical change involves dissociating or fragmenting a selected precursor ion and recording the mass spectrum of the resultant fragment or product ions. For example, the general approach used for obtaining a mass spectrometry/mass spectrometry (MS/MS or $MS^2$) spectrum can include isolating a selected precursor ion with a suitable m/z analyzer; subjecting the precursor ion to energetic collisions with a neutral gas for inducing dissociation; and finally mass analyzing the product ions in order to generate a mass spectrum. The information in the product ion mass spectrum can often be a useful aid in elucidating the structure of the precursor ion.

Typically, ions are fragmented or dissociated within a collision cell by the action of collisions with target molecules of an inert gas. The driving force for the collision is generally induced either by the application of an excitation field within the cell or by increasing the axial energy of the ions while the ions move into the cell. The ions' axial energy can be a function of a potential difference between the collision cell and one or more components, such as an ion guide or an electrostatic lens, located upstream of the cell.

Generally, the mass spectrometer system operates with a potential gradient extending between the region where the ions are generated (ion source) and the region where the ions are mass analyzed. The maximum potential that can be applied between any two components in the system is limited by the electrostatic discharge limit under the local conditions, such as the localized pressure or the component geometry. Consequentially, while maintaining a potential gradient through the system, the upper range of the axial energy available to the ions can be limited by the corresponding voltages applied to each component of the system. For example, certain molecules, such as phosphate polypeptides, are characterized as having ions with large m/z values (~2200 Daltons and greater), whereby the collision energy required for dissociation can be very high, in excess of 200-300 eV. In order to impart this level of energy to the large ions, it may be necessary to apply a high DC voltage (>500V) to one or more components. However, this may not be an option due to the potential for electrical discharge. A lower, discharge free voltage, can be sustained but the lower axial energy imparted to the ions may be insufficient for achieving efficient collision-induced dissociation.

SUMMARY

In view of the foregoing, the present teachings provide a method for improved ion fragmentation for mass spectrometry. The method comprises providing a high pressure ion guide configured for accepting ions from an ion source and for storing the ions at low potential energy. A barrier electrostatic field, for example, can be established at one or more ends of the high pressure ions guide for storing the ions. The potential energy of the stored ions can be raised, for example, by increasing the DC offset voltage of the high pressure ion guide, to a level predetermined by the energy requirement for collisional induced dissociation downstream of the high pressure ion guide. The stored ions can be released and accelerated from the high pressure ion guide when the stored ions have sufficient energy to overcome the barrier electrostatic field. The released ions can also undergo full mass or mass selective transmission so that precursor ions can be transmitted, with sufficient potential energy for CID fragmentation, into the collision cell. The product ions produced by the CID fragmentation, can be analyzed by a mass analyzer, such as a time-of-flight mass analyzer or a quadrupole mass analyzer.

The method also comprises providing a high pressure ion guide configured for accepting ions from an ion source and providing a collision cell configured for storing product ions. The collision cell, for example, can be configured with a negative DC offset voltage so to enable maintaining a discharge free condition upstream of the high pressure ion guide and with a potential well for storing the product ions. Ions can accelerate from the high pressure ion guide resulting in precursor ions transmitted into the collision cell. The accelerated ions can also undergo full mass or mass selective transmission so that precursor ions can be transmitted into the collision cell. The precursor ions can collide with a background gas in the collision cell to produce product ions for storage within the potential well of the collision cell. The potential energy of the stored product ions can be raised to a predetermined level sufficient for releasing the product ions from the collision cell for analysis by mass analyzer, such as a time-of-flight mass analyzer or a quadrupole mass analyzer.

These and other features of the present teachings are set forth herein.

BRIEF DESCRIPTION OF THE DRAWINGS

The skilled person in the art will understand that the drawings, described below, are for illustration purpose only. The drawings are not intended to limit the scope of the present teachings in anyway.

In the accompany drawings.

In the drawings, like reference numerals including like parts.

DESCRIPTION OF VARIOUS EMBODIMENTS

Figure 1:
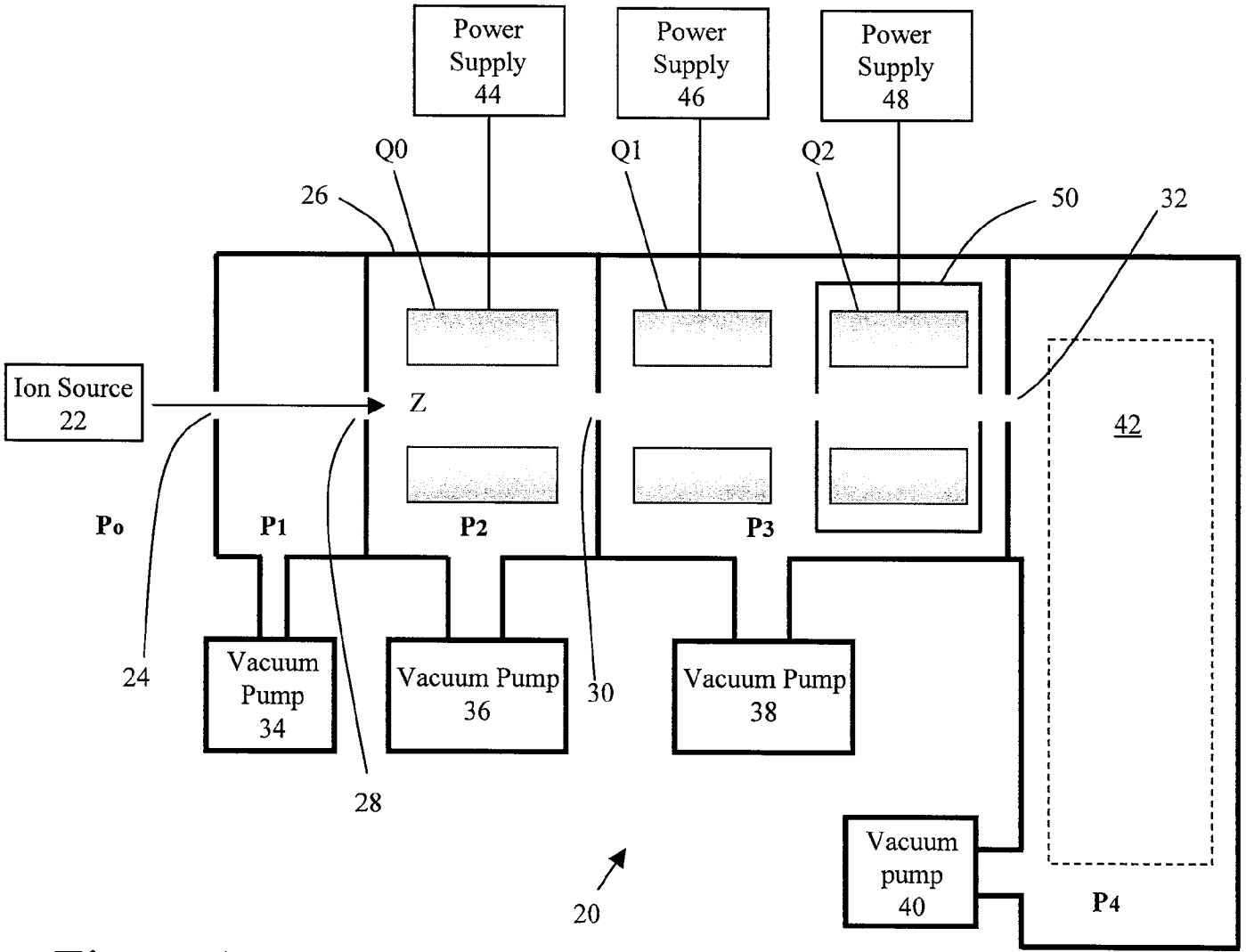
Figure 1 (PRIOR ART)
FIG. 1 is a schematic view of a prior art mass spectrometer of the type which can be used according to the present teachings.

It should be understood that the phrase "a" or 'an' used in conjunction with the present teachings with reference to various elements encompasses "one or more" or "at least one" unless the context clearly indicates otherwise. Reference is first made to FIG. 1, which shows schematically a prior art mass spectrometer 20 of the kind with which the present teachings can be used. The components of the mass spectrometer 20 comprise an ion source 22 configured to provide ions from a sample of interest. The ion source 22 which can be (depending on the type of sample) a laser desorption ionization source such as a matrix assisted laser desorption ionization (MALDI), an electrospray or ion spray source can be positioned in a high-pressure $P_0$ region operating at or near atmospheric pressure or operating at a pressure defined by a background gas. From the ion source 22, the ions can travel through an inlet aperture 24, also commonly known as an orifice, into a vacuum chamber 26 along the axial direction Z, as indicated by the arrow. The vacuum chamber 26 can be divided up into differentially pumped stages as defined by the inter-chamber apertures 28, 30, 32. The pressures $P_1$, $P_2$, $P_3$ and $P_4$ in each stage of the vacuum chamber 26 can be maintained by vacuum pumps 34, 36, 38 and 40 respectively. Vacuum chamber 26 can contain ion guides Q0, Q1, Q2 and mass analyzer 42 while appropriate RF and DC voltages can be applied to ion guides Q0, Q1, Q2 from power supplies 44, 46, 48. Generally, ions received by the high pressure ion guide Q0, operating with a pressure $P_2$ between 1 and 10 mtorr, can be subjected to radial confinement and collisional focusing as described in U.S. Pat. No. 4,963,736 while ion guide Q1 can function either as an ion mass filter (RF/DC voltage) to transmit ions having selective mass-charge ratios (m/z) or as an ion guide for full transmission of all ions indiscriminately (RF voltage only). Ion guide Q2 is largely enclosed in a housing 50 and configured to function as a collision cell. The housing 50 can be back-filled with an inert gas for maintaining a supply of target molecules to collide with the precursor ions for fragmentation due to collision induced dissociation, CID. Each of the apertures 24, 28, 30, 32 can be configured as electrostatic lenses connected to various power supplies to establish electric fields therebetween or with respect to ion guides Q0, Q1, Q2 for various stages to perform different ion functions, as will be discussed below.

Figure 2:
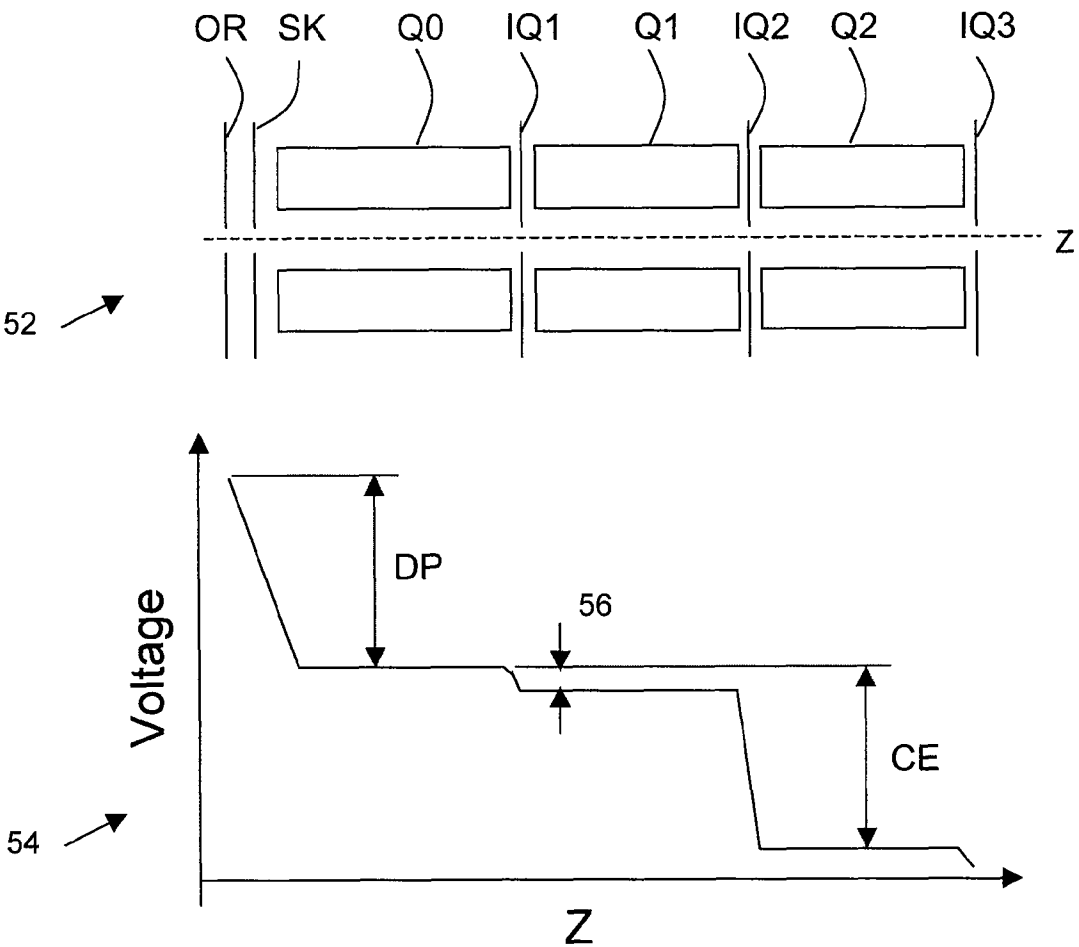
Figure 2 (PRIOR ART)
FIG. 2 is a schematic view of a prior art ion path and its corresponding relative voltage profile.

To help understand how ions from the ion source 22 can be stored at low potential energy, elevated to a higher potential energy and released with sufficient energy for collision induced dissociation, reference is now made to FIG. 2. The ion guides and lenses as previous describe according to FIG. 1, can be represented by the ion path 52, while the corresponding relative voltage levels applied to these components are graphically indicated by the potential profile 54 (voltage as a function of axial position Z, along the ion path 52). For simplicity, apertures 24, 28, 30 have been designated as the orifice, skimmer and the inter quadrupole lens OR, SK, IQ1 respectively, along with the additional electrostatic lenses IQ2, IQ3. With the appropriate voltages on OR, SK, Q0, IQ1, Q1, IQ2, Q2, IQ3, the potential gradient between the OR and lens IQ3, can be established to perpetuate an axial electric field in the corresponding downstream direction, as shown by the potential profile 54. As described above, one way of creating the electric field is to apply various DC voltages to the electrostatic lenses and, in various embodiments, a DC offset voltage, in addition to the RF voltage, can be applied to each of the ion guides Q0, Q1, Q2. Because the DC offset voltage is applied uniformly to each ion guide Q0, Q1, Q2, the potential is constant along the length of each ion guide as indicated, thus lacking any additional axial gradient field to perpetuate the ions' motion. The potential difference between the Q0 DC offset voltage and a voltage on the OR, however, can be configured so that ions from the ion source can be accelerated from the OR and accepted by the high pressure ion guide Q0 and, subsequently the kinetic energy of a group of ions transmitted between the OR and the skimmer SK can be increased. The energy helps to decluster the ions by minimizing the solvent molecules that may remain on the sample ions after they enter the vacuum chamber 26 as generally known. For brevity, the potential difference between the OR voltage and the Q0 DC offset voltage can be referred to as the declustering potential, DP as indicated in FIG. 2. The higher the DP, the higher the energy imparted to the ions, but if the DP is too high, unwanted fragmentation may occur.

Once the ions pass from Q0, the potential drop indicated at 56 can accelerate the ions between IQ1 and Q1 with sufficient momentum so that the ions can continue to be transmitted through ion guide Q1. As previously noted, depending on the nature of the voltage applied to ion guide Q1, the ions can be full mass transmitted indiscriminately (RF only) or can be mass selectively transmitted (resolving RF/DC). Generally in a MS/MS experiment, precursor ions are mass selected based on their mass-charge (m/z) ratio and only those selected precursors are allowed to be transmitted for analysis.

The Q1 transmitted ions can experience a further acceleration, due to the potential drop between Q1 and the Q2 collision cell. Provided that the ions have sufficient kinetic energy, the ions can accelerate into the collision cell and collide with the background gas molecules and resulting in ion dissociation (fragmentation) producing product ions. Accordingly, as indicated in FIG. 2, the potential difference between the Q0 DC offset voltage and the Q2 DC offset voltage can be used to establish the ions' collision energy (CE). As can be seen from FIG. 2, the orifice OR potential can be equal to or greater than the sum of the DP and the CE. With the example described above, phosphate polypeptide molecules typically require a CE of about 200-300 volts for CID fragmentation, and so the voltage applied to the OR can be of the order of 500 volts. In typical operation, however, since the OR is generally located in an environment where the pressure $P_1$ region can be about 1 Torr, the conditions characterized by this example can be favourable for electrostatic discharge which, if to be avoided, can compromise the availability of providing sufficient DP and/or CE levels.

In the above description, the CE is dependent on the relative static potentials applied to the components along the ion path 52. The applicants recognize that the functions for providing the CE and for providing the DP can be decoupled so to maintain a condition favourable for achieving higher CE without compromise. According to the present teachings, the potential energy of the ions can be initially established to satisfy the DP requirements while maintaining a discharge free condition under the typical operating pressure. Next, the potential energy of the ions can be changed so that sufficient CE becomes available for CID fragmentation. In various embodiments, for example, with reference to FIG. 3, the relative voltage levels applied to the components of ion path 52 can be represented by the potential profile 58 with time periods corresponding to $t=t_1$ and to $t=t_2$. At time period $t_1$, the DP can be chosen such that the voltage on the OR can be maintained at a discharge free level while the potential drop between the OR and Q0 can provide sufficient kinetic energy to the ions for the declustering process between the OR and the SK. According to the potential profile 58 of FIG. 3 at $t=t_1$, the Q0 DC offset voltage can be at a relatively low level, for example, at or near ground level which can be a configuration for allowing the Q0 ion guide to accept ions. During the $t_1$ time period, a barrier electrostatic field at one or both axial ends of the Q0 ion guide can be established to prevent the ions from moving pass the ends so to aid in storing a group of ions within the Q0 volume. This can be achieved with an appropriate voltage level 60 applied to the IQ1 lens so that the group of ions, having low potential energy, are not likely to overcome the barrier. While the group of ions remain stored within the volume of Q0, the potential energy of the ions remains at the low level. At time period $t_2$, the Q0 DC offset voltage can be increased so to raise the potential energy of the stored ions to a higher level, for example 400 V. While the stored ions' potential energy increases to a predetermined energy level corresponding to the CE required for the CID fragmentation in Q2, the stored ions can have sufficient energy to overcome the barrier and can be released from the volume. Once released, the stored ions can be accelerated for transmission through Q1 and into the Q2 collision cell.

Figure 3:
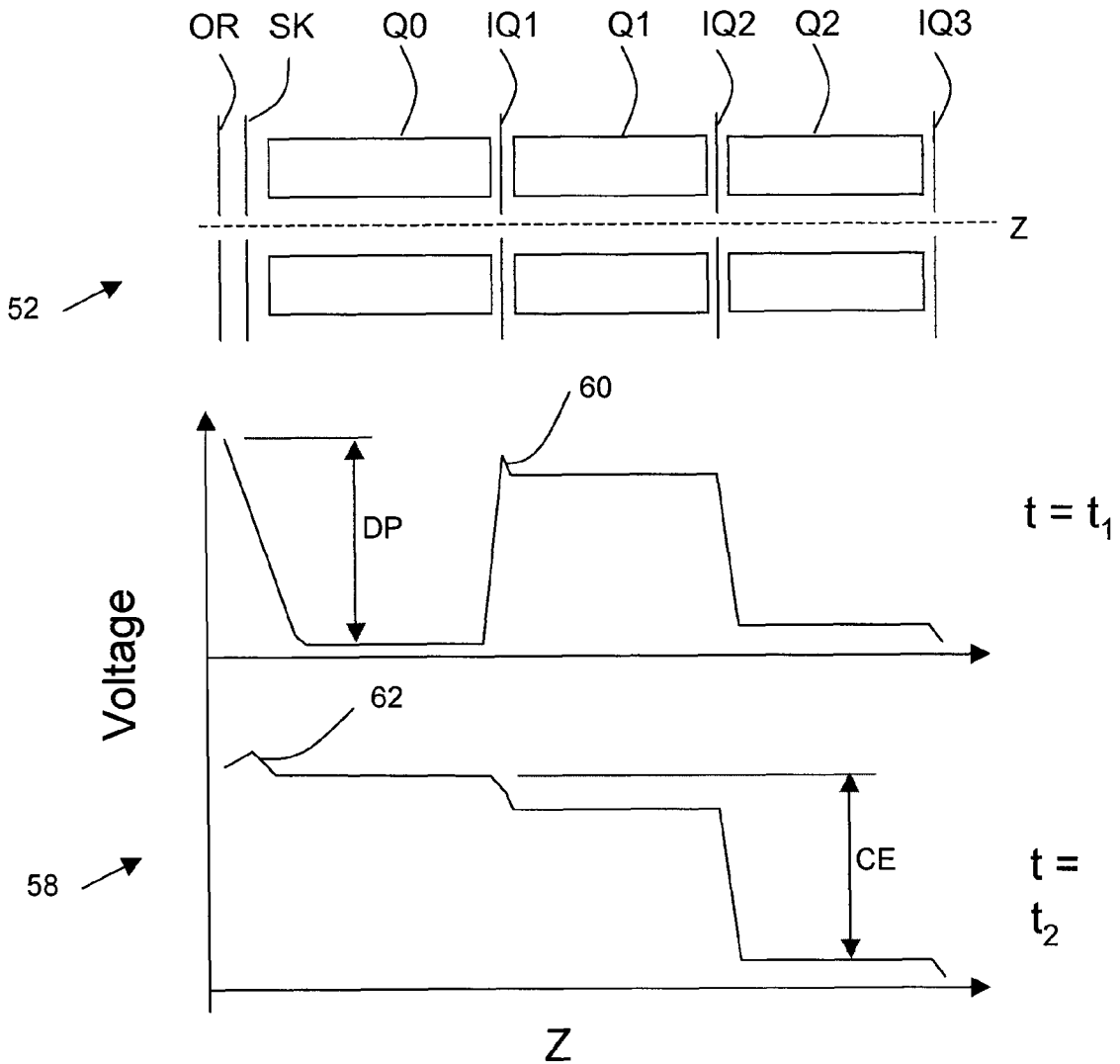
FIG. 3 is a schematic view of an ion path and its corresponding relative voltage profiles according to the present teachings.

Similar to the description as applied to FIG. 2, according to FIG. 3 at $t=t_2$, the CE is defined by the potential difference between the Q0 DC offset voltage and the Q2 DC offset voltage, however, the CE is now associated with the ions previously stored at a lower potential energy and lifted (raised) to a higher potential energy suitable for CID fragmentation. Consequently, this effectively decouples the relationship between the CE and the OR functions, thus providing the possibility for independent voltage assignments. Regardless of how the CE is established, the resulting released stored ions can be transmitted into Q1 for full mass transmission or mass selected transmission. Unless otherwise specified, the term precursor ions can be generalized to include group of ions resulting from full transmission or from mass selected transmission or a combination thereof. In the normal manner, the precursor ions can be transmitted into the Q2 collision cell for CID fragmentation. The product ions formed in the collision cell, and some remaining precursor ions if they were not completely fragmented, can be analyzed by mass analyzer 42 or can be subjected to other forms of ion processing, such as additional fragmentation or reaction, prior to mass analysis. For brevity the term product ions can include a mixture of remnant precursor ions and of ions produced from dissociating the precursor ions. Typical mass analyzer 42 in the present teachings can include time-of-flight (TOF) mass analyzers, quadrupole mass analyzers and ion trap mass analyzers (including linear, 3D and orbital trap types).

While the present teachings are described in conjunction with various embodiments, it is not intended that the present teachings be limited to such embodiments. On the contrary, the present teachings encompass various alternatives, modifications, and equivalents, as will be appreciated by those of skill in the art. For example, the present applicants recognize that once the potential energy of the stored ions is raised, the ions can remain stored within Q0 provided that the ions' potential energy is below the barrier field potential 60. After a specified duration, say at $t=t_3$, the IQ1 lens barrier voltage can be lowered to allow the stored ions to be released.

In various embodiments, according to FIG. 3 at $t=t_2$, the voltage applied to the skimmer SK can be held at a higher level relative to the voltages on the orifice OR and on the Q0 ion guide as indicated by reference numeral 62. This creates a relative potential barrier at the entrance to Q0 effectively preventing additional ions from being accepted into Q0. Alternatively, the skimmer SK can be replaced with a configuration comprising of an additional ion guide, such as a quadrupole ion guide as described in U.S. Pat. No. 7,256,395 assigned to the assignee of the present teachings, operable at the P1 pressure (typically in the 1 Torr region as noted above) to provide additional ion focusing and declustering. The additional ion guide can be configured to establish a relative potential barrier as above.

Figure 4:
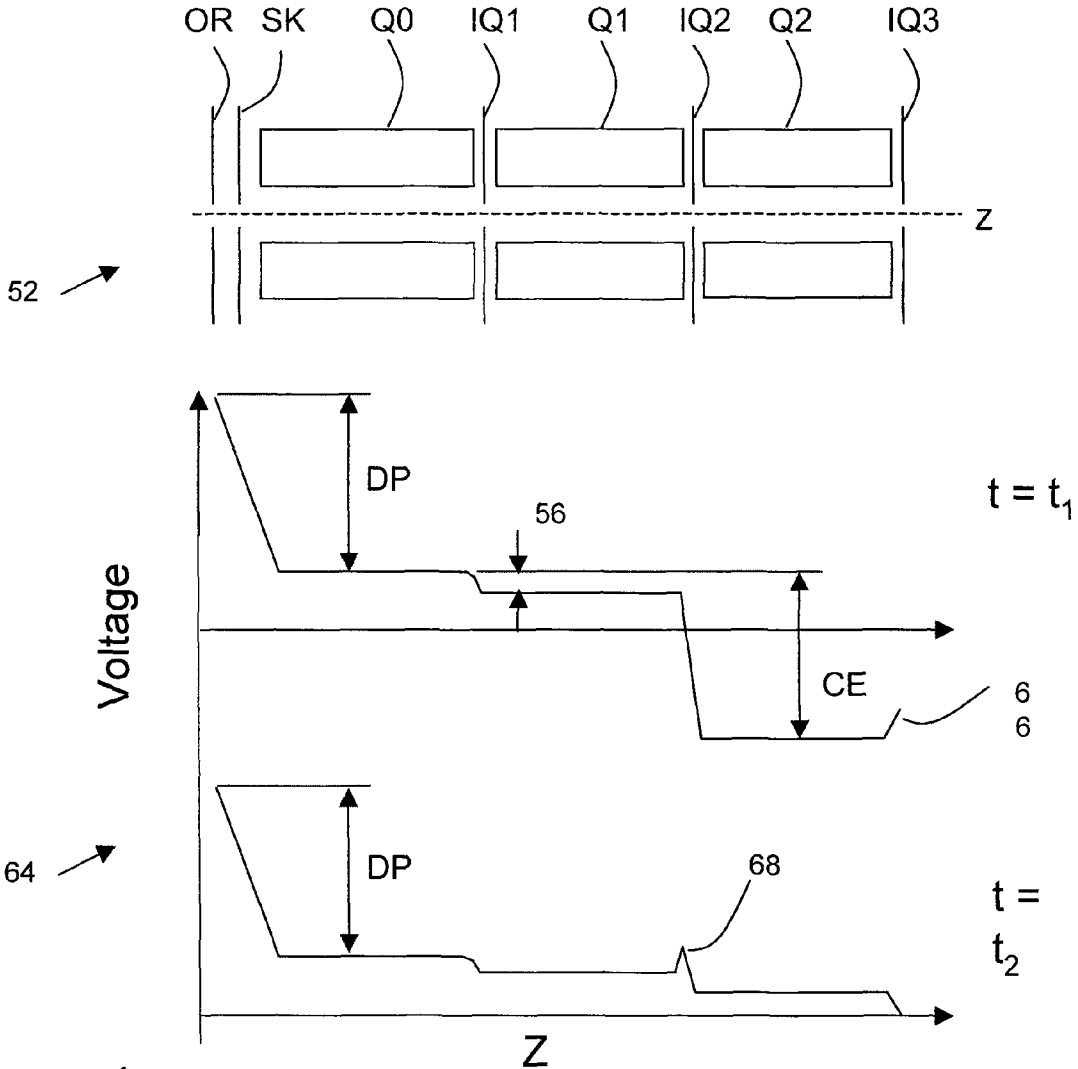
FIG. 4 is a schematic view of various embodiments of the present teachings.

In various embodiments, the operation of the Q2 collision cell can be configured for storing ions to enable decoupling the CE and DP functions. For example, as illustrated in FIG. 4, during the time period $t=t_1$ of the potential profile 64, the absolute OR potential can be maintained at a level sufficiently low for satisfying a discharge free condition while the Q2 DC offset voltage initially can be set to a negative value. The DP and the potential drop 56, illustrated by the potential profile 64, can allow ions to be accepted into Q0 ion guide and subsequently accelerated for transmission into the Q2 collision cell for CID fragmentation. As described previously, prior to the Q2 collision cell, the ions can undergo full mass or mass selective transmission through Q1 resulting in transmitting precursor ions from Q1 into the collision cell Q2. The potential difference between the negative Q2 DC offset voltage and the Q0 offset voltage can provide sufficient CE for CID fragmentation. In this example, the configuration is such that the Q0 DC offset voltage can be maintained at a positive voltage, say +300 volts, relative to the absolute OR potential for allowing Q0 ion guide to receive ions and the Q2 DC offset voltage maintained at a negative voltage, say −300 volts, for providing a CE of +600 volts.

Following fragmentation, however, because the Q2 DC offset voltage was initially set at the negative value, the potential energy of the product ions, and any remaining precursor ions, can be insufficient for further ion processing. This means that, although the ions can possess sufficient kinetic energy for fragmentation, the resulting product ions can be trapped and stored within a potential well predetermined by the voltage levels between IQ2, Q2 and IQ3. Generally, unless the potential energy of the product ions can be raised, or the downstream barrier of the potential well, generally indicated by reference number 66, can be lowered, the product ions can remain trapped within the collision cell. Lowering the downstream potential barrier 66, however, may not be an option if the mass analyzer 42 or other ion processing function, downstream of Q2, is typically set at a level greater than the Q2 DC offset voltage, effectively maintaining a trapping condition in Q2.

Consequently, at time period $t=t_2$, the potential energy of the stored product ions can be raised to the predetermined level by increasing the Q2 DC offset voltage so that the stored product ions can be released from the Q2 collision cell. Subsequently, the released product ions can further be subjected to ion processing such as mass analysis by mass analyzer 42. In various embodiments, for example, at $t=t_2$, the voltage applied to the lens IQ2 can be held at a higher level relative to the voltages on Q0 and on the collision cell Q2 as indicated by reference numeral 68. This creates a relative potential barrier at the entrance to Q2 effectively preventing additional ions from being accepted into Q2.

EXAMPLE

Figure 5:
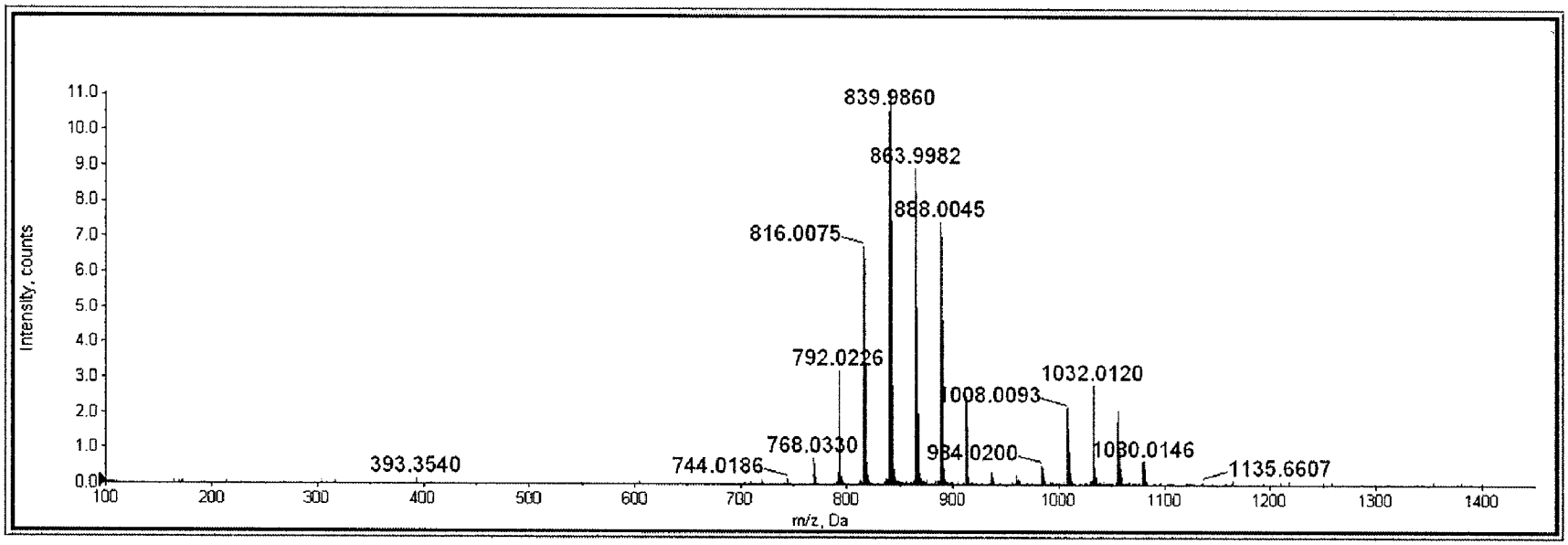
FIG. 5 is an exemplary mass spectrum of a known compound demonstrating the performance of a tandem mass spectrometer in accordance with the present teaching.

FIG. 5 shows the CID spectrum of a tandem mass spectrometer in accordance with the present teachings resulting from a MALDI sample of $C_{90}$ fullerene and monitoring the fragments of m/z 1080 precursor ions. Typically, with fullerenes, below collision energy of 200 V, little fragmentation is observed; however, using Q0 DC offset voltage of 300 V and Q2 DC offset voltage of −190 V, the CE was 490 V resulting in observed fragment products as indicated by the labelled peaks.

The invention claimed is:

1. A method of performing tandem mass spectrometry comprising:

providing a high pressure ion guide configured for accepting ions;

storing the ions in the high pressure ion guide;

raising the potential energy of the stored ions so that the stored ions have a predetermined energy level for collisional induced dissociation;

releasing the stored ions from the high pressure ion guide and transmitting precursor ions into a collision cell, the collision cell having a background gas;

colliding the precursor ions with the background gas and dissociating the precursor ions to produce product ions; and analyzing the product ions.

2. The method of claim 1 further comprising mass selecting precursor ions from the released stored ions for transmission into the collision cell.

3. The method of claim 2 further comprising operating the high pressure ion guide at near ground potential while storing the ions.

4. The method of claim 3 wherein raising the potential energy of the stored ions is by increasing a DC offset voltage of the high pressure ion guide.

5. The method of claim 4 wherein the product ions are analyzed with a time-of-flight analyzer.

6. A method of performing tandem mass spectrometry comprising:

providing a high pressure ion guide configured for accepting ions and providing a collision cell configured for storing product ions;

accelerating the ions from the high pressure ion guide and transmitting precursor ions into the collision cell, the collision cell having a background gas;

colliding the precursor ions with the background gas to produce product ions;

storing the product ions in the collision cell;

raising the potential energy of the product ions to a predetermined level sufficient for releasing the product ions from the collision cell; and analyzing the product ions.

7. The method of claim 6 further comprising mass selecting precursor ions from the group of ions for transmission into the collision cell.

8. The method of claim 7 wherein the high pressure ion guide configuration comprise of operating with a positive DC offset voltage for accepting the ions and the collision cell configuration comprise of operating with a negative DC offset voltage for storing the product ions.

9. The method of claim 8 wherein the product ions are analyzed with a time-of-flight analyzer.

* * * * *